US009814998B2

(12) United States Patent
Wei

(10) Patent No.: US 9,814,998 B2
(45) Date of Patent: Nov. 14, 2017

(54) MAGNETICALLY CONNECTED BLOCK

(71) Applicant: SHENZHENSHI HANTONG TECHNOLOGY CO., LTD., BaoAn, ShenZhen, Guangdong (CN)

(72) Inventor: Zhengpeng Wei, Guangdong (CN)

(73) Assignee: SHENZHENSHI HANTONG TECHNOLOGY CO., LTD. (CN)

( * ) Notice: Subject to any disclaimer, the term of this patent is extended or adjusted under 35 U.S.C. 154(b) by 0 days.

(21) Appl. No.: 15/349,705

(22) Filed: Nov. 11, 2016

(65) Prior Publication Data

US 2017/0136381 A1 May 18, 2017

Related U.S. Application Data

(63) Continuation of application No. PCT/CN2015/076455, filed on Apr. 13, 2015.

(30) Foreign Application Priority Data

May 12, 2014 (CN) ..... 2014 2 0241689 U

(51) Int. Cl.
*A63H 33/04* (2006.01)
*A63H 33/26* (2006.01)
*A63H 33/10* (2006.01)

(52) U.S. Cl.
CPC ..... *A63H 33/042* (2013.01); *A63H 33/046* (2013.01); *A63H 33/10* (2013.01); *A63H 33/26* (2013.01)

(58) Field of Classification Search
CPC ..... A63H 33/042; A63H 33/046; A63H 33/04
USPC ..... 446/85, 91, 92, 124, 129, 131; 439/13, 439/39
See application file for complete search history.

(56) References Cited

U.S. PATENT DOCUMENTS 2,795,893 A * 6/1957 Vayo ..... A63H 33/046 446/92
2,939,243 A * 6/1960 Duggar ..... A63H 33/046 273/157 R
5,520,396 A * 5/1996 Therrien ..... A63F 9/34 273/156

(Continued)

FOREIGN PATENT DOCUMENTS

CN 2245796 Y 1/1997
CN 103394201 A 11/2013

(Continued)

*Primary Examiner* — Alexander Niconovich
(74) *Attorney, Agent, or Firm* — St. Onge Steward Johnston & Reens, LLC

(57) ABSTRACT

A magnetically connected block, including an electrically conductive connector, the electrically conductive connector defining therein a cavity and a magnet being arranged in the cavity, the electrically conductive connector being provided with a contact surface and a conductive device being provided on the contact surface. In this way, the electrically conductive connector achieves the electrical conduction between blocks by way of the conductive device and achieves the connection between two blocks by way of the magnet to ensure the connection by attraction and the electrical connection between blocks. Owing to the arrangement of the magnet, blocks can be attracted onto a magnetic attraction board surface to facilitate teaching use.

12 Claims, 8 Drawing Sheets

(56) References Cited

U.S. PATENT DOCUMENTS

| | | | | |
|---|---|---|---|---|
| 5,746,638 | A * | 5/1998 | Shiraishi | A63H 33/046 446/131 |
| 6,024,626 | A * | 2/2000 | Mendelsohn | A63H 33/046 446/124 |
| 6,749,480 | B1 * | 6/2004 | Hunts | A63H 33/046 446/85 |
| 7,320,633 | B2 * | 1/2008 | Park | A63H 33/046 446/131 |
| 7,731,558 | B2 * | 6/2010 | Capriola | A63H 33/042 273/120 A |
| 7,988,518 | B2 * | 8/2011 | Kim | A63H 33/046 446/129 |
| 8,128,452 | B2 * | 3/2012 | Kim | A63H 33/046 446/129 |
| 8,371,894 | B1 * | 2/2013 | Rosen | A63H 33/086 446/102 |
| 8,850,683 | B2 * | 10/2014 | Haughey | A63H 33/046 29/428 |
| 9,227,147 | B2 * | 1/2016 | Kim | A63H 33/046 |
| 9,433,871 | B2 * | 9/2016 | Park | A63H 33/102 |
| 2005/0164595 | A1 * | 7/2005 | Toht | A63H 33/046 446/92 |
| 2006/0134978 | A1 * | 6/2006 | Rosen | A63H 33/042 439/581 |
| 2008/0139077 | A1 * | 6/2008 | Patton | A63H 33/046 446/92 |
| 2010/0022158 | A1 * | 1/2010 | Kim | A63H 33/06 446/92 |
| 2010/0087119 | A1 * | 4/2010 | Vicentelli | A63H 33/046 446/92 |
| 2010/0120322 | A1 * | 5/2010 | Vicentelli | A63H 33/046 446/92 |
| 2011/0263177 | A1 * | 10/2011 | Lemchen | A63H 33/04 446/87 |
| 2012/0270465 | A1 * | 10/2012 | Park | A63H 33/046 446/129 |
| 2015/0065007 | A1 * | 3/2015 | Klepper | A63H 33/046 446/92 |
| 2016/0367906 | A1 * | 12/2016 | Purns | A63H 33/06 |

FOREIGN PATENT DOCUMENTS

| | | | |
|---|---|---|---|
| CN | 103418147 | A | 12/2013 |
| CN | 203466001 | U | 3/2014 |
| CN | 103933742 | A | 7/2014 |
| CN | 203724777 | U | 7/2014 |
| CN | 203736862 | U | 7/2014 |
| CN | 203829653 | U | 9/2014 |
| CN | 203842321 | U | 9/2014 |

* cited by examiner

MAGNETICALLY CONNECTED BLOCK

FIELD OF THE INVENTION

The present invention relates to splicing toys, and more particularly to a magnetically connected block.

BACKGROUND OF THE INVENTION

Learning through electronic blocks is intuitive and interesting. Electronic splicing devices may be applied to the real life. Electronic blocks show complex electronic circuitry knowledge to the children visually through simple blocks so that they can experience the interest of the electronic world and children at different ages can learn contents with different difficulties.

Electronic blocks on the current market and in the prior art are unique and splicable accessories connected through unique snap fasteners which fix electronic components such as wires, lamps, diodes, triodes, resistors, capacitors, various switches, electric meters, motors, loudspeakers, integrated blocks, etc. on a plastic plate (block).

Chinese patent No. CN2245796Y "Universal electronic block" discloses all techniques of this traditional electronic block. Such an electronic block has to adopt an installation base and various element pieces are connected to each other and conduct the circuit by using metal snap fasteners as connectors and conductive joints. However, such a traditional electronic block has the following defects: 1) it has to be plugged and unplugged hard during the actual use and even has to be equipped with an installation base, thus the splicing method is not easy and convenient enough; 2) snap fasteners being used as conductive connectors causes serious electricity consumption and are easy to be damaged; 3) the connection method is single and merely single connections of snap fasteners are possible, which limits the stack-up diversity and interest of electronic blocks; and 4) it cannot be attracted onto a magnetically attractable plate (such as a white plate) and the applicability needs to be expanded further.

SUMMARY OF THE INVENTION

An object of the present invention is to provide a magnetically connected block to solve one or more of the above problems.

In order to achieve the above object, according to one aspect of the present invention, a magnetically connected block is provided which comprises an electrically conductive connector and a magnet. A cavity is provided inside the electrically conductive connector. The magnet is provided in the cavity. The electrically conductive connector is provided with a contact surface. A conductive device is provided on the contact surface. In this way, the electrically conductive connector achieves the electrical conduction between blocks by means of the conductive device and achieves the connection between two blocks by means of the magnet to ensure the connection by attraction and the electrical connection between blocks. Owing to the arrangement of the magnet, blocks can be attracted onto a magnetic attraction board surface to facilitate teaching use.

In some embodiments, the conductive device is a conductive coating and this coating is coated on the contact surface. In this way, the provision of the conductive coating can make the structure of the block simpler.

In some embodiments, the electrically conductive connector includes an end surface and a side surface which are both provided with the contact surface. The end surface is an arc surface. The conductive coating is provided on the end surface and the side surface. In this way, when the electrically conductive connectors of blocks contact to each other, the front end of one electrically conductive connector makes point contact with the other electrically conductive connector. Such point contact will not reduce the attraction force between the electrically conductive connectors. Rather, it can greatly improve the electric conduction performance, reduce potential consumption, and facilitate the connection of more blocks. Furthermore, blocks can have certain arc splicing angle transition without the magnetic attraction force being affected and the splicing diversity and entertainment of electronic blocks can be further improved.

In some embodiments, the magnet is close to the end surface and the side surface is provided with a magnetically attractable metal correspondingly. In this way, when blocks are attracted and connected to each other, the magnet of one block is attracted to the magnet or magnetically attractable metal of the other block. The connection line between the magnet and the magnetic attraction metal of the same electrically conductive connector is triangular and the magnet and the magnetically attractable metal can both keep close to the contact surface, which improves the attraction and connection performance of blocks to each other.

In some embodiments, the conductive device is the magnet and the contact surface is provided with an opening with the edge of the magnet projecting from the opening. In this way, the magnet itself has good electrical conductivity, which can reduce the resistance and improve the stability of electrical connections. Since the magnet is used for direct connection, the magnetic attraction force is stronger and the connection between blocks is closer. Therefore, the requirements to the magnetic field intensity of the magnet are lowered.

In some embodiments, the magnet is cylindrical and magnetized radially and the magnet is rotatable in the cavity. In this way, due to ability of the rotation of the magnet, the electrically conductive connector can achieve attraction and electrical connection at multiple angles.

In some embodiments, a central pillar is provided in the cavity and an axial through-hole is provided at the center of the magnet with the central pillar passing through the axial through-hole. In this way, the provision of the central pillar and the axial through-hole can locate the magnet at the center of the cavity, which facilitates the rotation of the magnet and the adjustment of directions of its magnetic pole.

In some embodiments, the magnetically connected block further includes a functional circuit connected to the conductive device. In this way, the functional circuit may be a battery, a light-emitting module, a switch module, a sliding rheostat module, or a sounding module, which may make the block have various functions and enhance the splicing diversity.

In some embodiments, the magnetically connected block comprises a plurality of electrically connected connectors. In this way, the number of electrically connected connectors may be set as required, thus enhancing the applicability of the block.

In some embodiments, the magnetically connected block further includes an elastic connector made of a non-magnetically attractable material with one end thereof abutting the magnet and the other end electrically connected to the functional circuit. In this way, the elastic connector achieves the electrical connection between the magnet and the functional circuit, which has a stable connection and is not easy to be affected by the rotation of the magnet.

In some embodiments, the elastic connector is a tension spring or an elastic plate. In this way, either the tension spring or the elastic plate may achieve the electrical connection between the magnet and the functional circuit.

In some embodiments, the magnetically connected block further includes a casing and the electrically connected connector is provided on the casing. In this way, the casing supports the electrically connected connector.

In some embodiments, the casing is provided with a cover and the functional circuit includes a function execution device located inside the cover. In this way, the cover can protect the function execution device from being damaged. The cover may be transparent or semi-transparent so as to facilitate a user observing the operating state of the function execution device.

The beneficial effects of the present invention are as follows. The electrically connected connector of the magnetically connected block adopts a magnet which is magnetized radially and may spin, which can achieve attraction and electrical connection at multiple surfaces and multiple angles. The magnet projects from the opening of the contact surface, which can not only ensure the close connection between blocks but can also achieve the electrical connection of the functional circuits of blocks. The present solution needs few simple connection components, which can greatly reduce the manufacture costs. The magnet itself has good electrical conductivity, which can reduce the resistance and improve the stability of electrical connections. Since the magnet is used for direct connection, the magnetic attraction force is stronger, the connection between blocks is closer, and the requirements on the magnetic field intensity of the magnet are lowered.

The contact surface of the electrically connected connector of the magnetically connected block may be further provided with a conductive coating, which ensures the electrical connection between blocks. Moreover, the magnet is enclosed in the electrically connected connector, which effectively reduces the manufacture costs. The end surface of the electrically connected connector is made arc. When the electrically conductive connectors of blocks contact two by two, the front end of one electrically conductive connector makes point contact with the other electrically conductive connector. Such point contact will not reduce the attraction force between the electrically conductive connectors rather can greatly improve the electric conduction performance, reduce potential consumption, and facilitates the connection of more blocks. Furthermore, blocks can have certain arc splicing angle transition without the magnetic attraction force being affected and the splicing diversity and entertainment of electronic blocks can be further improved.

DETAILED DESCRIPTION OF THE INVENTION

Hereinafter, the present invention will be described in detail further in conjunction with the drawings.

Embodiment 1

Figure 1:
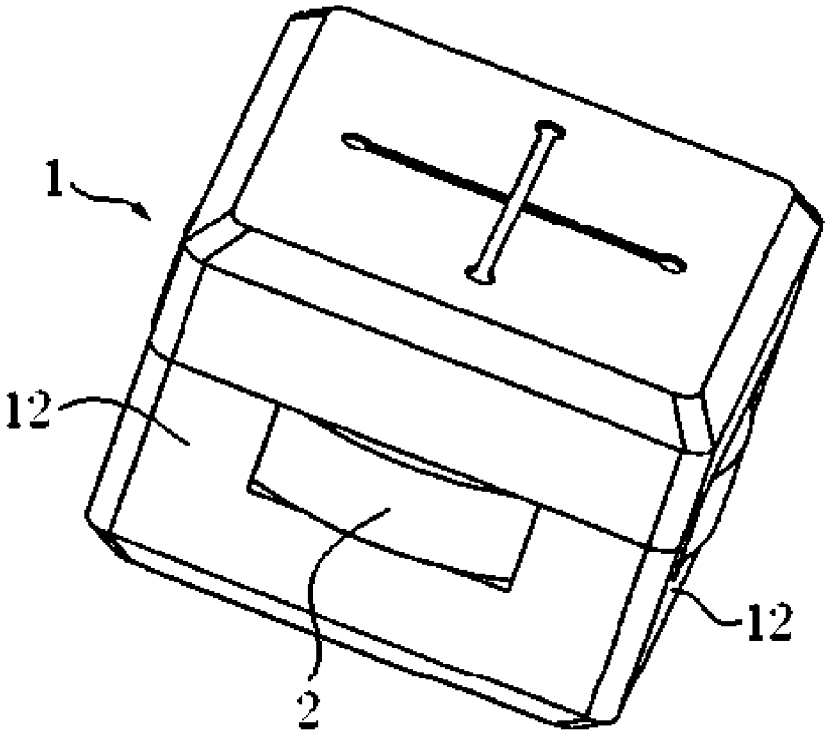
FIG. 1 is a structure diagram of a magnetically connected block according to embodiment 1 of the present invention.
Figure 2:
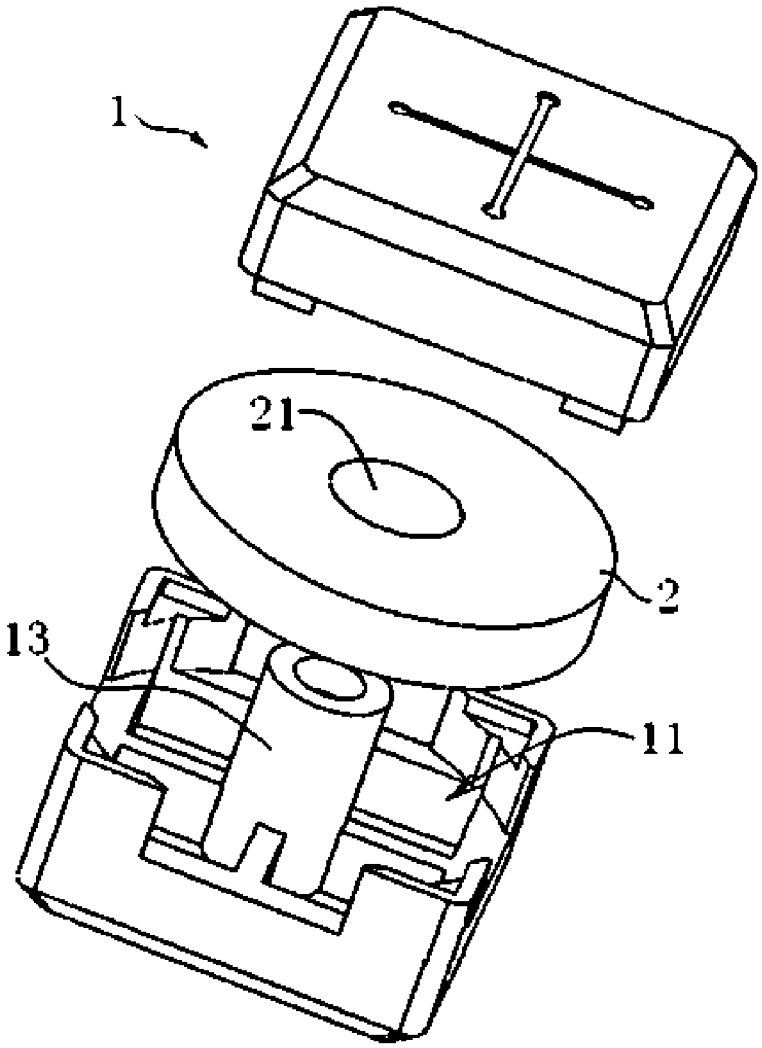
FIG. 2 is an explosion diagram of the magnetically connected block shown in FIG. 1.

As shown in FIGS. 1 and 2, the magnetically connected block in this embodiment includes an electrically conductive connector 1. The electrically conductive connector 1 includes an upper casing and a lower casing fixedly connected to each other. The upper casing and the lower casing form a cavity 11. A central pillar 13 is provided in the cavity 11. The central pillar 13 and the lower casing form an integral structure. A magnet 2 magnetized radially is provided in the cavity 11. The magnet 2 is cylindrical. An axial through-hole 21 is provided at the center of the magnet 2. The central pillar 13 passes through the axial through-hole 21 which cause the magnet 2 rotatable in the cavity 11 about the central axis. Four side surfaces of the electrically conductive connector 1 are all contact surfaces 12. The contact surface 12 is provided with an opening. The radial edge of the magnet 2 projects from the opening. That is, the diameter of the magnet 2 is greater than the length and width of the cavity 11.

When two such blocks are attracted and connected to each other, the magnet in the electrically conductive connector 1 may rotate to adjust its magnetic pole, which can achieve attraction and electrical connection at multiple surfaces and multiple angles. The four side surfaces of the magnetically connected block in this embodiment all can connect other blocks, which have a connection function.

Embodiment 2

Figure 3:
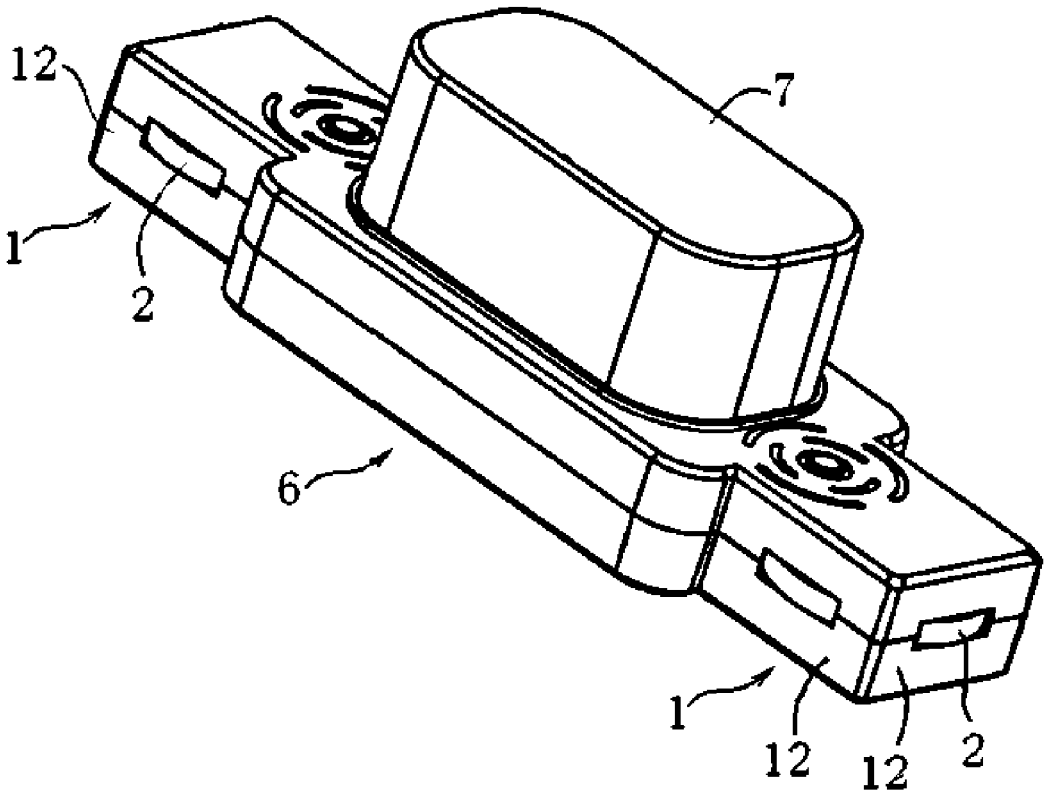
FIG. 3 is a structure diagram of a magnetically connected block according to embodiment 2 of the present invention.
Figure 4:
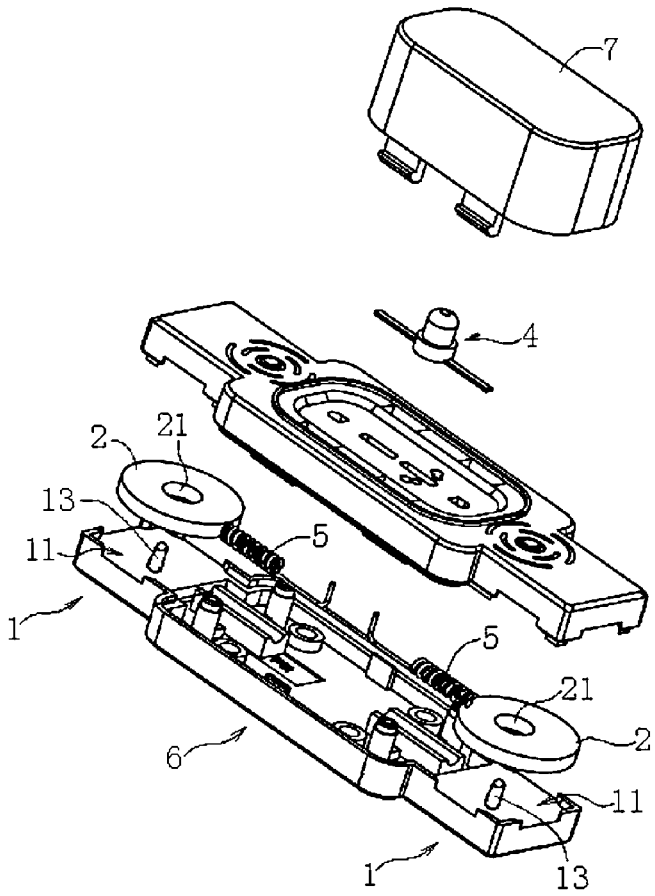
FIG. 4 is an explosion diagram of the magnetically connected block shown in FIG. 3.

As shown in FIGS. 3 and 4, the magnetically connected block in this embodiment includes an electrically conductive connector 1, a casing 6 and a functional circuit 4. The functional circuit 4 is installed on the casing 6. The upper part of the casing 6 is fixedly provided with a cover 7. A function execution device of the functional circuit 4 is located in the cover 7. There may be a plurality of electrically conductive connectors 1 as required. The function execution device of the functional circuit 4 may be a battery, a light-emitting module, a switch module, a sliding rheostat module, a sounding module, a resistor, an inductor, a capacitor, a motor, a switch and the like, which are provided according to the particular function requirements of the block.

The two ends of the casing 6 are connected to the electrically conductive connector 1 respectively. The electrically conductive connector 1 includes an upper casing and a lower casing fixedly connected to each other. The upper casing and the lower casing form a cavity 11. The upper casing and the lower casing of the electrically conductive connector 1 form an integral structure. A central pillar 13 is provided in the cavity 11. The central pillar 13 and the lower casing of the electrically conductive connector 1 form an integral structure. A magnet 2 magnetized radially is provided in the cavity 11. The magnet 2 is cylindrical. An axial through-hole 21 is provided at the center of the magnet 2. The central pillar 13 passes through the axial through-hole 21. The magnet 2 can rotate in the cavity 11 about its central axis. Three outer side surfaces of the electrically conductive connector 1 are all contact surfaces 12. The contact surface 12 is provided with an opening. The radial edge of the magnet 2 projects from the opening. That is, the diameter of the magnet 2 is greater than the length and width of the cavity 11.

The magnetically connected block in this embodiment further includes an elastic connector made of a non-magnetically attractable material 5 with one end thereof abutting the magnet 2 and the other end electrically connected to the functional circuit 4 to achieve the electrical connection between the magnet 2 and the functional circuit 4. The elastic connector 5 can be a tension spring or an elastic plate.

Embodiment 3

Figure 5:
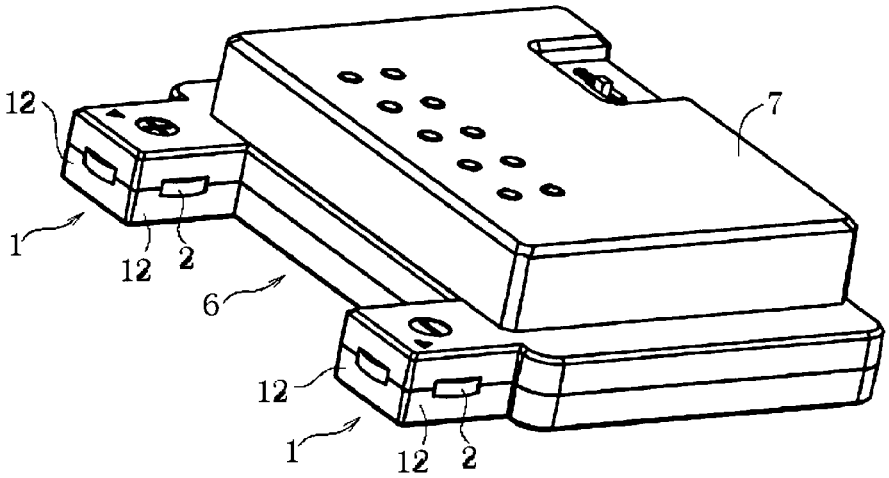
FIG. 5 is a structure diagram of a magnetically connected block according to embodiment 3 of the present invention.
Figure 6:
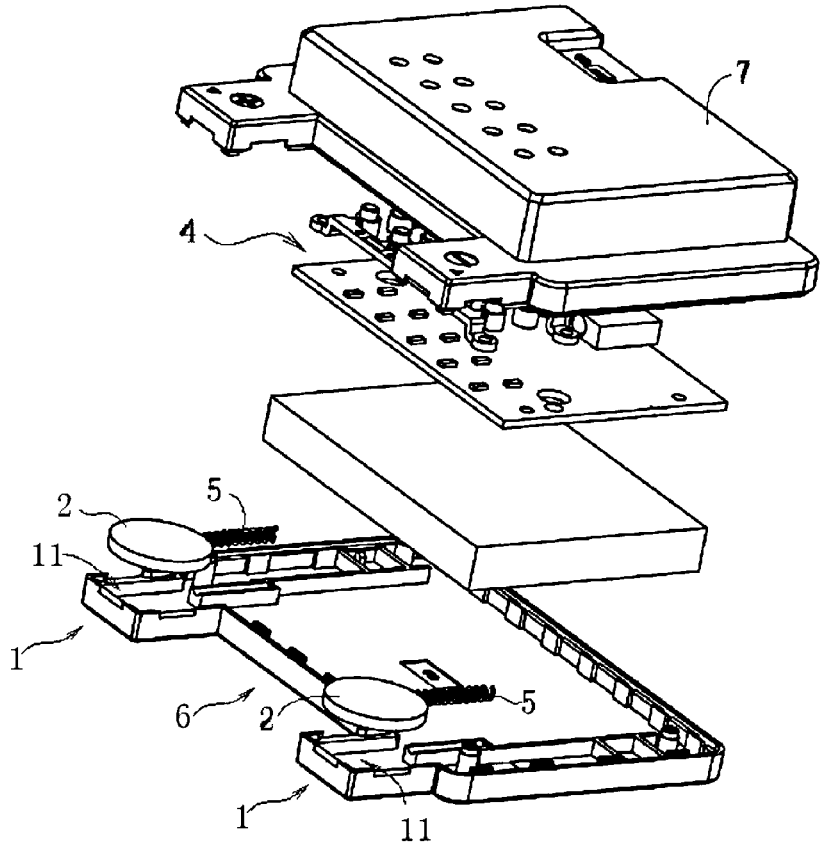
FIG. 6 is an explosion diagram of the magnetically connected block shown in FIG. 5.

As shown in FIGS. 5 and 6, the magnetically connected block in this embodiment is substantially the same as that of the embodiment 2. The differences lie in that, in this embodiment, there is no central pillar in the cavity 11 and there is no central axial hole in the magnet 2. The functional circuit 4 is a power circuit and an indicator circuit. Two electrically conductive connectors 1 are located at the same side of the block. The electrically conductive connectors 1 are a positive connector and a negative connector.

Embodiment 4

Figure 7:
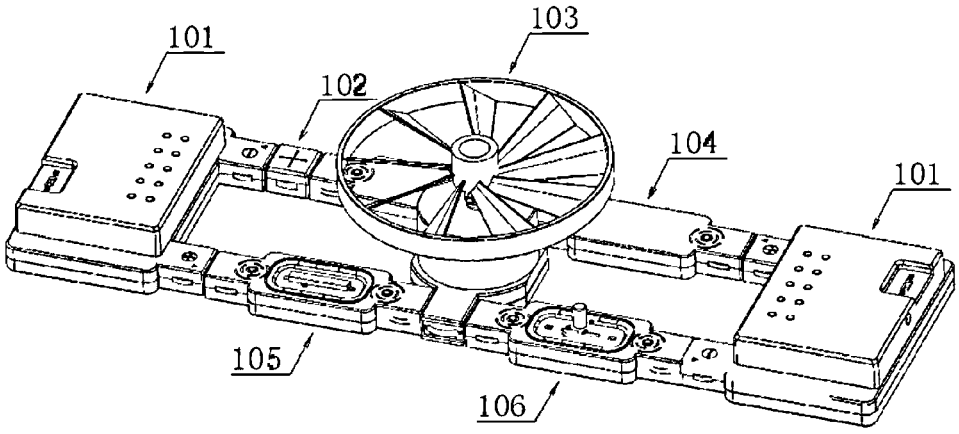
FIG. 7 is a diagram of a complete circuit loop formed by the splicing of the magnetically connected blocks in embodiments 1, 2 and 3 according to embodiment 4 of the present invention.

As shown in FIG. 7, a fan which can be adjusted to rotate clockwise or anticlockwise is spliced, which uses a battery module block 101, a length adjustment block 102, a fan module block 103, a wire module block 104, a switch module block 106 and a reed switch module block 105. The splicing method of all these block modules is as shown in FIG. 7. When the switch on the switch module block 106 is turned on, the fan on the fan module block 103 rotates clockwise. When the switch on the switch module block 106 is turned off, the reed switch on the reed switch module block 105 is conducted and the fan on the fan module block 103 rotates anticlockwise.

The battery module block 101 may use the magnetically connected block in embodiment 3. The length adjustment block 102 may use the magnetically connected block in embodiment 1. The fan module block 103, the wire module block 104, the switch module block 106 and the reed switch module block 105 may use the magnetically connected block in embodiment 2. The functional circuit of the fan module block 103 is a fan circuit. The functional circuit of the wire module block 104 is a wire for connecting two electrically conductive connectors 1. The functional circuit of the switch module block 106 is a switch circuit. The functional circuit of the reed switch module block 105 is a reed switch circuit.

Embodiment 5

Figure 8:
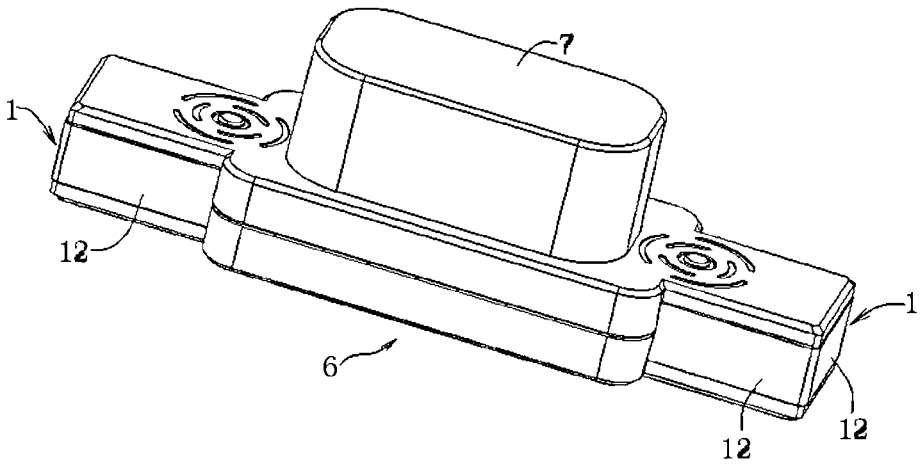
FIG. 8 is a structure diagram of a magnetically connected block according to embodiment 5 of the present invention.
Figure 9:
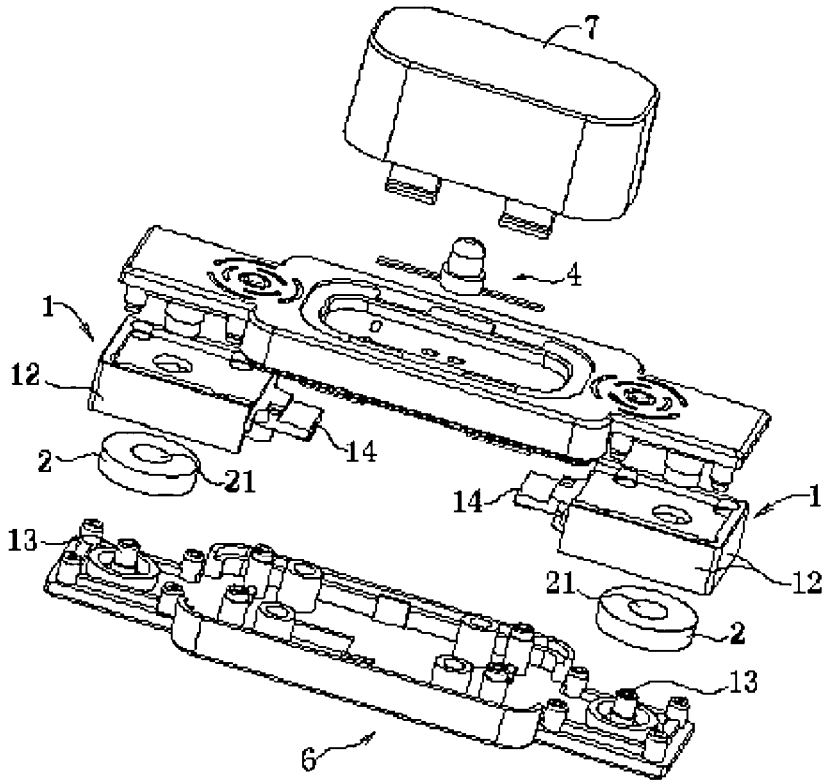
FIG. 9 is an explosion diagram of the magnetically connected block shown in FIG. 8.

As shown in FIGS. 8 and 9, the magnetically connected block in this embodiment includes an electrically conductive connector 1, a casing 6 and a functional circuit 4. The functional circuit 4 is installed on the casing 6. The upper part of the casing 6 is fixedly provided with a cover 7. A function execution device of the functional circuit 4 is located in the cover 7. There may be a plurality of electrically conductive connectors 1 as required. The function execution device of the functional circuit 4 may be a battery, a light-emitting module, a switch module, a sliding rheostat module, a sounding module, a resistor, an inductor, a capacitor, a motor, a switch and the like, which are provided according to the particular function requirements of the block.

There are two electrically conductive connectors 1 in this embodiment and they are provided at the two ends of the casing 6 respectively. The upper side and the lower side of the electrically conductive connector 1 are connected to the casing 6. A cavity (not shown) is provided inside the electrically conductive connector 1. A central pillar 13 is provided in the cavity. The end portion of the central pillar 13 is connected to the casing 6. A magnet 2 magnetized radially is provided in the cavity. The magnet 2 is cylindrical. An axial through-hole 21 is provided at the center of the magnet 2. The central pillar 13 passes through the axial through-hole 21. The magnet 2 can rotate in the cavity 11 about the central axis.

The end surface and two side surfaces of the electrically conductive connector 1 are all contact surfaces 12. The contact surface 12 is coated with a conductive coating. The rear end of the electrically conductive connector 1 is provided with an end pin 14. The end pin 14 is electrically connected to the conductive coating on the contact surface 12 and the other end is electrically connected to the functional circuit 4. Thus, the electrical connection between the contact surface 12 and the functional circuit 4 is achieved. When blocks are attracted and connected to each other, the contact surfaces 12 of the two contact to each other to achieve an electrical conductive connection.

Embodiment 6

Figure 10:
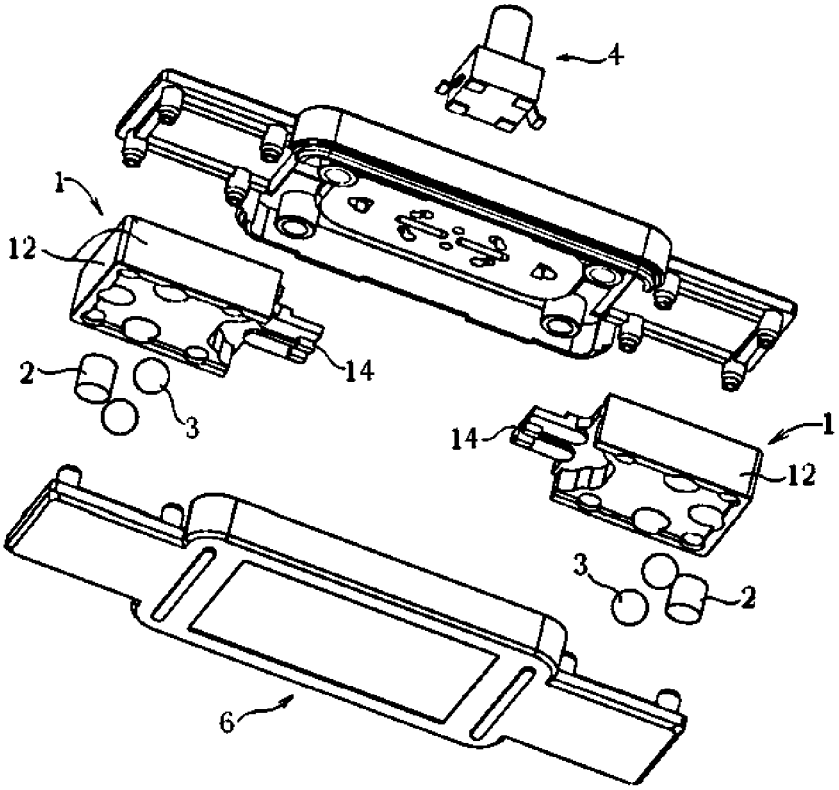
FIG. 10 is a structure diagram of a magnetically connected block according to embodiment 6 of the present invention.

As shown in FIG. 10, the magnetically connected block in this embodiment is substantially the same as that of the embodiment 5. The differences lie in that the end surface and the two side surfaces of the electrically conductive connector 1 are all contact surfaces 12. The magnet 12 is close to the end surface and the two side surfaces are both provided with a magnetically attractable metal 3 correspondingly. A hole for accommodating the magnetically attractable metal 3 is provided in the electrically conductive connector 1.

Embodiment 7

Figure 11:
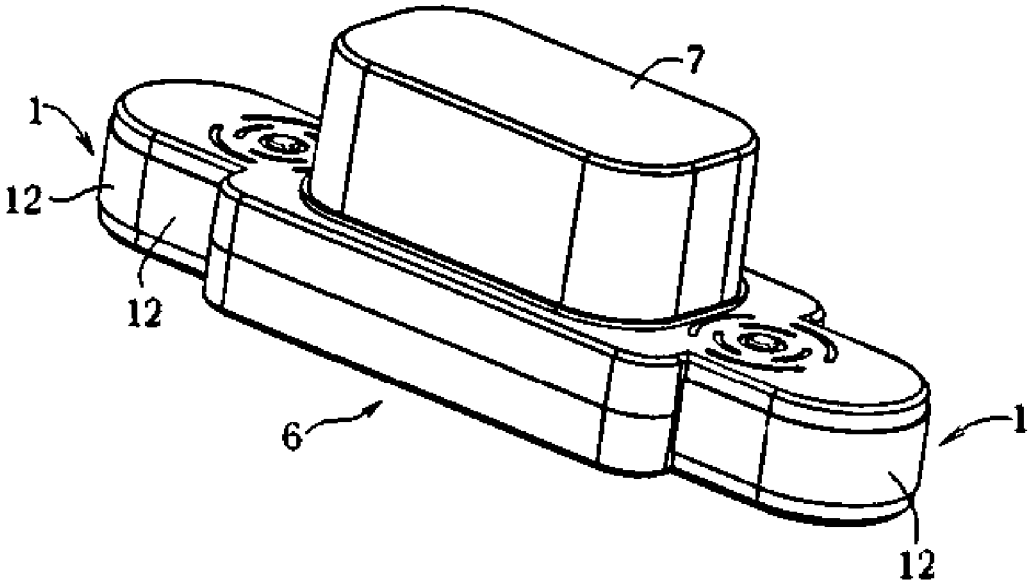
FIG. 11 is a structure diagram of a magnetically connected block according to embodiment 7 of the present invention.
Figure 12:
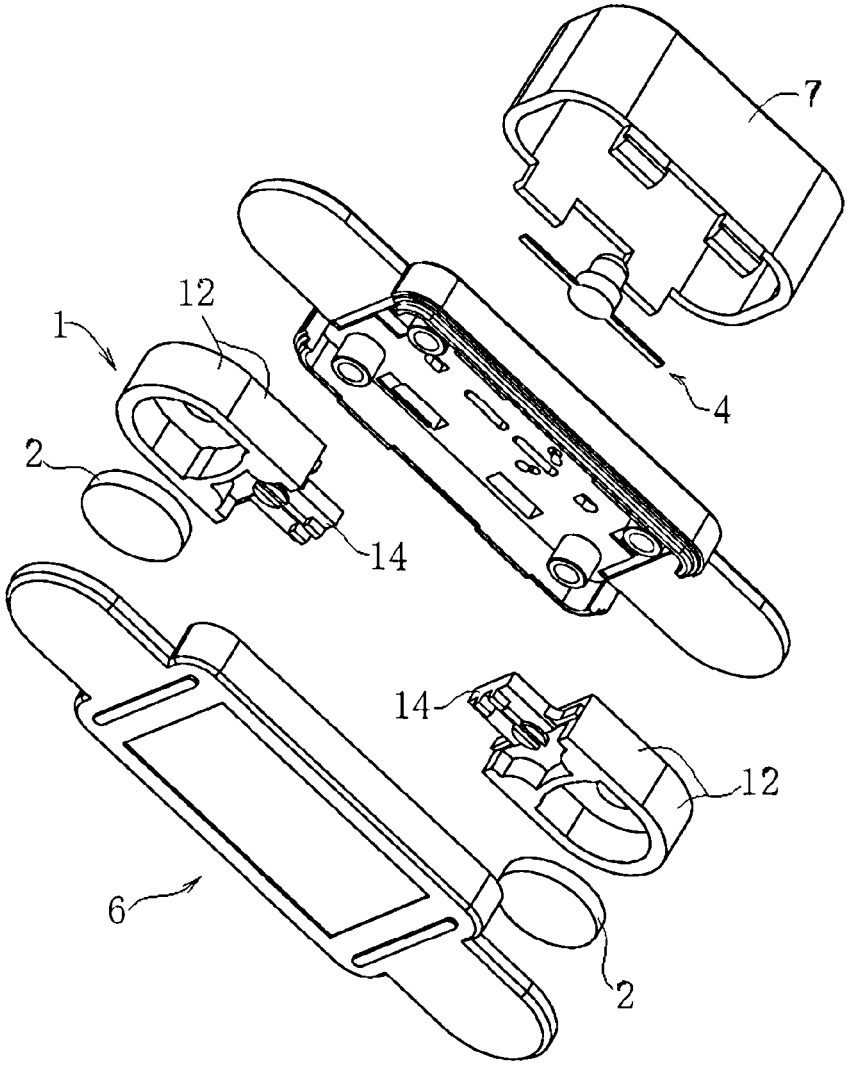
FIG. 12 is an explosion diagram of the magnetically connected block shown in FIG. 11.

As shown in FIGS. 11 and 12, the magnetically connected block in this embodiment is substantially the same as that in embodiment 5. The differences lie in that the end surface of the electrically conductive connector 1 is an arc surface and a conductive coating is provided at the end surface and two side surfaces of the electrically conductive connector.

When the electrically conductive connectors 1 of two blocks contact to each other, the front end of the electrically conductive connector 1 of one block makes point contact with the other electrically conductive connector 1. Such point contact will not reduce the attraction force between the electrically conductive connectors 1. Rather, it can greatly improve the electric conduction performance, reduce potential consumption, and facilitates the connection of more blocks. Furthermore, blocks can have certain arc splicing angle transition without the magnetic attraction force being affected and the splicing diversity and entertainment of electronic blocks can be further improved.

The foregoing is merely some embodiments of the present invention. For a person skilled in the art, variations and modifications may be made without departing from the inventive concept of the present invention, which all fall into the protection scope of the present invention.

What is claimed is:

1. A magnetically connected block comprising:

an electrically conductive connector having a plurality of contact surfaces defining a cavity, a conductive device being provided on each of the plurality of contact surfaces, and a magnet arranged in the cavity such that the magnet creates magnetic forces at multiple of the plurality of contact surfaces, wherein the magnet is cylindrical and magnetized radially and wherein the magnet is rotatable in the cavity such that the magnetic poles at the multiple contact surfaces are adjustable by rotating the magnet.

2. The magnetically connected block according to claim 1, wherein the conductive device is a conductive coating and the conductive coating is coated on the contact surface.

3. The magnetically connected block according to claim 2, wherein the electrically conductive connector includes an end surface and a side surface which are both provided with the contact surface and the end surface is an arc surface.

4. The magnetically connected block according to claim 3, wherein the magnet is close to the end surface and the side surface is provided with a magnetically attractable metal correspondingly.

5. The magnetically connected block according to claim 1, wherein the conductive device is the magnet and the contact surface is provided with an opening with an edge of the magnet projecting from the opening.

6. The magnetically connected block according to claim 1, wherein a central pillar is provided in the cavity and an axial through-hole is provided at a center of the magnet with the central pillar passing through the axial through-hole.

7. The magnetically connected block according to claim 1, wherein the magnetically connected block further comprises a functional circuit electrically connected to the conductive device.

8. The magnetically connected block according to claim 7, wherein the magnetically connected block comprises a plurality of electrically conductive connectors.

9. The magnetically connected block according to claim 7, wherein the magnetically connected block further comprises an elastic connector made of a non-magnetically attractable material with one end thereof abutting the magnet and another end electrically connected to the functional circuit.

10. The magnetically connected block according to claim 9, wherein the elastic connector is a tension spring or an elastic plate.

11. The magnetically connected block according to claim 7, wherein the magnetically connected block further comprises a casing to which the electrically conductive connector is connected.

12. The magnetically connected block according to claim 11, wherein the casing is provided with a cover and the functional circuit comprises a function execution device arranged inside the cover.

* * * * *